US009879869B2

(12) United States Patent
Hamada et al.

(10) Patent No.: US 9,879,869 B2
(45) Date of Patent: Jan. 30, 2018

(54) PARTITION MEMBER FOR TOTAL HEAT EXCHANGE ELEMENT, TOTAL HEAT EXCHANGE ELEMENT USING THIS MEMBER, AND TOTAL HEAT EXCHANGE TYPE VENTILATION DEVICE

(71) Applicant: Panasonic Intellectual Property Management Co., Ltd., Osaka (JP)

(72) Inventors: Yousuke Hamada, Aichi (JP); Miyuki Ootomo, Aichi (JP); Keita Takahashi, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 11 days.

(21) Appl. No.: 14/897,477

(22) PCT Filed: Jun. 17, 2014

(86) PCT No.: PCT/JP2014/003238

§ 371 (c)(1),
(2) Date: Dec. 10, 2015

(87) PCT Pub. No.: WO2014/203519

PCT Pub. Date: Dec. 24, 2014

(65) Prior Publication Data

US 2016/0123609 A1 May 5, 2016

(30) Foreign Application Priority Data

Jun. 20, 2013 (JP) ..... 2013-129162
Sep. 12, 2013 (JP) ..... 2013-189198

(51) Int. Cl.
*B01F 3/04* (2006.01)
*F28F 3/00* (2006.01)
(Continued)

(52) U.S. Cl.
CPC ..... *F24F 3/147* (2013.01); *B01F 3/04007* (2013.01); *F24F 3/04* (2013.01);
(Continued)

(58) Field of Classification Search
CPC .... B01F 3/04; B01F 3/04007; B01F 3/04085; F28F 3/00
(Continued)

(56) References Cited

U.S. PATENT DOCUMENTS 8,550,151 B2 * 10/2013 Murayama ..... F24F 3/147 165/133
2009/0068437 A1 3/2009 Miyagoshi et al.
2014/0242900 A1 8/2014 Takada et al.

FOREIGN PATENT DOCUMENTS

CN 101631999 1/2010
JP 2003-287387 10/2003
(Continued)

OTHER PUBLICATIONS

International Search Report of PCT application No. PCT/JP2014/003238 dated Sep. 16, 2014.
(Continued)

*Primary Examiner* — Robert A Hopkins
(74) *Attorney, Agent, or Firm* — McDermott Will & Emery LLP

(57) ABSTRACT

A partition member for total heat exchange element (14) includes an ultrafine fiber portion (17) on a porous sheet (18). The ultrafine fiber portion (17) is impregnated with or coated with a moisture permeable substance (21), and water-insolubilized.

9 Claims, 4 Drawing Sheets

(51) Int. Cl.

| | |
|---|---|
| ***F24F 3/147*** | (2006.01) |
| ***F24F 3/04*** | (2006.01) |
| ***F28F 13/18*** | (2006.01) |
| ***F28D 9/00*** | (2006.01) |
| ***F28D 21/00*** | (2006.01) |
| ***F28F 9/02*** | (2006.01) |
| ***F28F 3/04*** | (2006.01) |
| *F28F 3/08* | (2006.01) |
| *F24F 3/14* | (2006.01) |

(52) U.S. Cl.
CPC ..... *F28D 9/0037* (2013.01); *F28D 21/0014* (2013.01); *F28D 21/0015* (2013.01); *F28F 3/048* (2013.01); *F28F 9/0202* (2013.01); *F28F 13/18* (2013.01); *F24F 2003/1435* (2013.01); *F28F 3/08* (2013.01); *F28F 2250/106* (2013.01)

(58) Field of Classification Search
USPC ..... 261/154; 165/133
See application file for complete search history.

(56) References Cited

FOREIGN PATENT DOCUMENTS

| | | |
|---|---|---|
| JP | 2005-288216 | 10/2005 |
| JP | 2008-014623 | 1/2008 |
| JP | 2011-237157 | 11/2011 |
| JP | 2012-137284 | 7/2012 |
| WO | 2013/061419 A1 | 5/2013 |

OTHER PUBLICATIONS

English Translation of Chinese Search Report dated Dec. 23, 2016 for the related Chinese Patent Application No. 201480034936.4.

* cited by examiner

PARTITION MEMBER FOR TOTAL HEAT EXCHANGE ELEMENT, TOTAL HEAT EXCHANGE ELEMENT USING THIS MEMBER, AND TOTAL HEAT EXCHANGE TYPE VENTILATION DEVICE

CROSS-REFERENCE TO RELATED APPLICATIONS

This application is a U.S. national stage application of the PCT International Application No. PCT/JP2014/003238 filed on Jun. 17, 2014, which claims the benefit of foreign priority of Japanese patent applications 2013-129162 filed on Jun. 20, 2013 and 2013-189198 filed on Sep. 12, 2013, the contents all of which are incorporated herein by reference.

TECHNICAL FIELD

The present invention relates to a partition member for total heat exchange element, a total heat exchange element using the member, and a total heat exchange type ventilation device.

BACKGROUND ART

With a total heat exchange type ventilation device, supplied air and exhaust air exchange heat during ventilation. Thus, ventilation can be carried out without impairing the effect of space cooling and space heating. Such a total heat exchange type ventilation device uses a partition member for total heat exchange element having a heat transfer property and moisture permeability, and a total heat exchange element using the partition member for total heat exchange element as a partition plate.

The material of the total heat exchange element is required to have a gas barrier property (mainly a carbon dioxide barrier property) preventing supplied air and exhaust air from being mixed with each other, and heat conductivity. In particular, the total heat exchange element which performs sensible heat exchange and latent heat exchange simultaneously is also required to have high moisture permeability. Further, in the case where the difference between indoor temperatures and outdoor temperatures is great, such as in cold climate areas and the tropics, dew condensation or freezing occurs inside the element. Therefore, water resistance property is also required.

Accordingly, a partition member for total heat exchange element used for a total heat exchange element is prepared as follows. That is, a partition member for total heat exchange element is obtained by coating a moisture permeable substance being an aqueous solution of hydrophilic polymer over a porous sheet containing hydrophilic fibers by 30% by weight or more, and thereafter water-insolubilized (for example, see PTL 1).

CITATION LIST

Patent Literature

PTL 1: Unexamined Japanese Patent Publication No. 2008-14623

SUMMARY OF THE INVENTION

With the conventional partition member for total heat exchange element, the moisture permeable substance is directly coated over the porous sheet containing hydrophilic fibers by 30% by weight or more. Accordingly, the thickness of the moisture permeable substance is great, and the moisture permeation performance is low. That is, when the moisture permeable substance is just coated over the surface of the porous sheet, the layer of the moisture permeable substance may peel off from the porous sheet. Therefore, with the conventional partition member for total heat exchange element, it is necessary for a layer with great hydrophilic fibers to be impregnated with the moisture permeable substance.

However, with the conventional partition member for total heat exchange element, the thickness of the layer with great hydrophilic fibers cannot be adjusted. Accordingly, in order to secure the gas barrier property, the moisture permeable substance is coated more than necessary, whereby the thickness of the moisture permeable substance is increased. As a result, the total heat exchange type ventilation device has problems of low moisture permeation performance and low total heat exchange efficiency.

Accordingly, an object of the present invention is to provide a partition member for total heat exchange element including a porous sheet, and an ultrafine fiber portion provided on the porous sheet. The ultrafine fiber portion is impregnated with or coated with a moisture permeable substance and water-insolubilized.

Since such a partition member for total heat exchange element uses the porous sheet as a base material, the required strength can be secured. Accordingly, the ultrafine fiber portion can be formed to be thin with a small fiber diameter. Further, by virtue of the small fiber diameter, the ultrafine fiber portion can absorb the moisture permeable substance by capillary force. Thus, the moisture permeable substance can be collected in the ultrafine fiber layer, and it becomes easier to control the thickness of the moisture permeable substance. Further, by virtue of the small fiber diameter, the voidage of the ultrafine fiber portion can be increased while maintaining the strength of the ultrafine fiber portion. Thus, the content of the moisture permeable substance can be increased. As a result, a layer densely containing the moisture permeable substance by a small thickness can be formed. Accordingly, a partition member for total heat exchange element exhibiting high moisture permeation performance can be obtained, and a total heat exchange type ventilation device exhibiting high total heat exchange efficiency can be obtained.

DESCRIPTION OF EMBODIMENT

In the following, with reference to the drawings, a description will be given of an exemplary embodiment of the present invention.

Exemplary Embodiment

Figure 1:
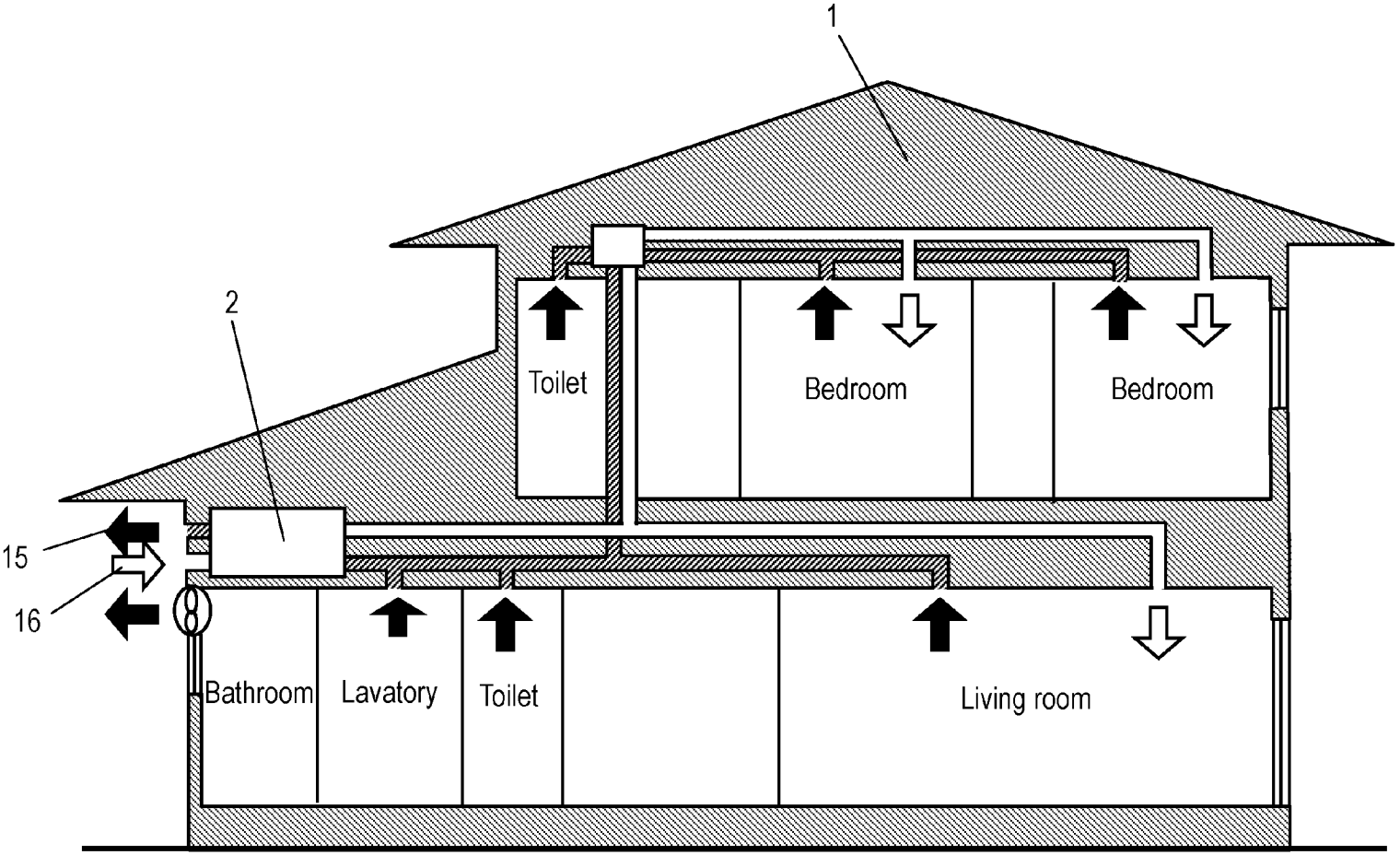
FIG. 1 is a schematic diagram showing an installation example of a total heat exchange type ventilation device according to an embodiment of the present invention.

FIG. 1 is a schematic diagram showing an installation example of a total heat exchange type ventilation device according to the exemplary embodiment of the present invention. As shown in FIG. 1, total heat exchange type ventilation device 2 is installed in house 1. Room air 15 is, as represented by black arrows, released to the outside via total heat exchange type ventilation device 2. Further, outdoor air 16 is, as represented by white arrows, taken inside the rooms via total heat exchange type ventilation device 2. As a result, ventilation is performed. Further, in wintertime, the heat of room air 15 is transferred to outdoor air 16, and the heat of room air 15 is suppressed from being released.

Figure 2:
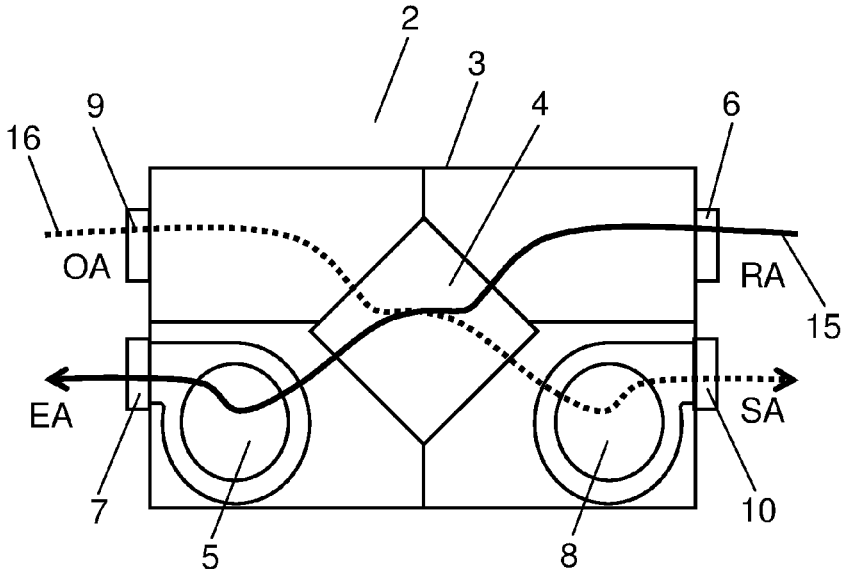
FIG. 2 is a diagram showing the structure of the total heat exchange type ventilation device.

FIG. 2 is a diagram showing the structure of the total heat exchange type ventilation device according to the exemplary embodiment of the present invention. As shown in FIG. 2, total heat exchange type ventilation device 2 has body case 3, and total heat exchange element 4 disposed in body case 3. When fan 5 is driven, room air 15 is taken from room air port 6, and discharged to the outside from exhaust air port 7 via total heat exchange element 4 and fan 5.

Further, when fan 8 is driven, outdoor air 16 is taken from outdoor air port 9, and taken inside the house from supply air port 10 via total heat exchange element 4 and fan 8.

Figure 3:
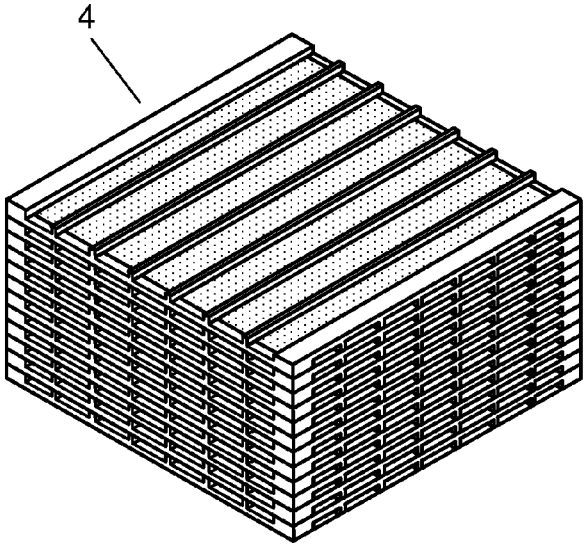
FIG. 3 is a perspective view showing a total heat exchange element of the total heat exchange type ventilation device.
Figure 4:
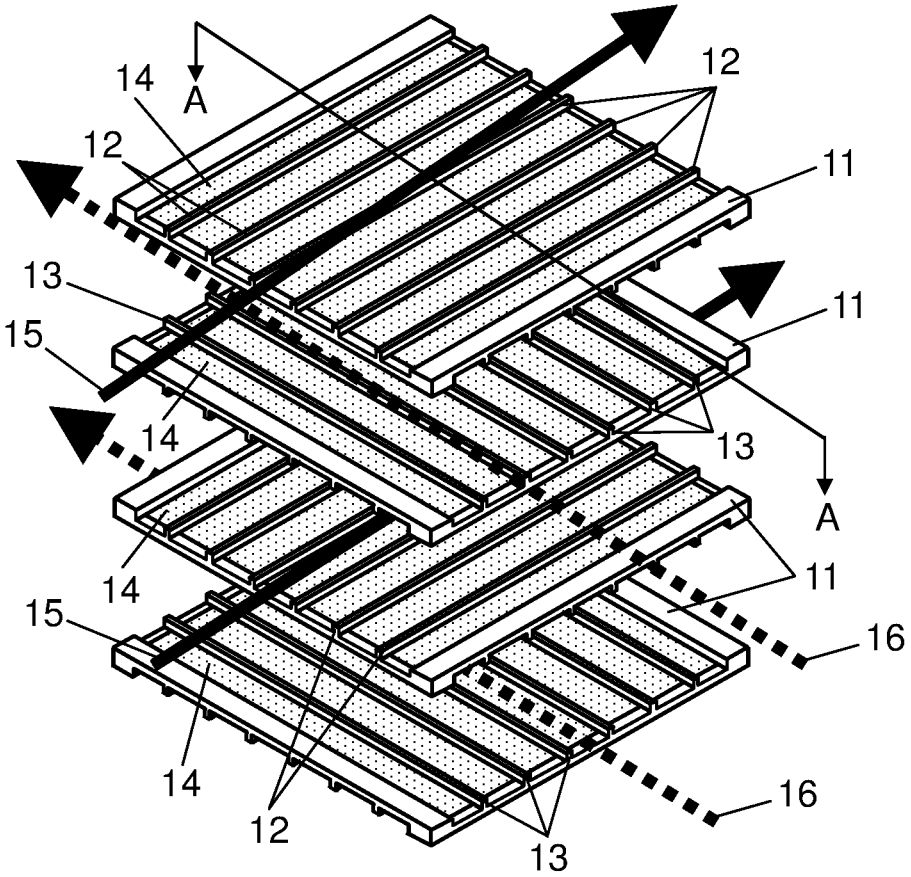
FIG. 4 is an exploded perspective view showing the total heat exchange element of the total heat exchange type ventilation device.

FIG. 3 is a perspective view showing the total heat exchange element of the total heat exchange type ventilation device according to the exemplary embodiment of the present invention. FIG. 4 is an exploded perspective view showing the total heat exchange element of the total heat exchange type ventilation device. As shown in FIGS. 3 and 4, in total heat exchange element 4, partition member for total heat exchange element 14 is attached to a rectangular opening of each frame 11. Then, room air duct ribs 12 and outdoor air duct ribs 13 are alternately stacked with a prescribed interval. Room air 15 is caused to flow between adjacent frames 11 and outdoor air 16 is caused to flow between next adjacent frames 11, whereby heat exchange between room air 15 and outdoor air 16 is performed.

In wintertime, room air 15 contains moisture from space-heating, exhalation, and the like. Further, the outdoor air 16 is dry. By room air 15 and outdoor air 16 respectively flow along the opposite surfaces of partition member for total heat exchange element 14, heat of room air 15 is transferred to outdoor air 16. Further, by moisture transfer via partition member for total heat exchange element 14, moisture in room air 15 is transferred to outdoor air 16.

Figure 5:
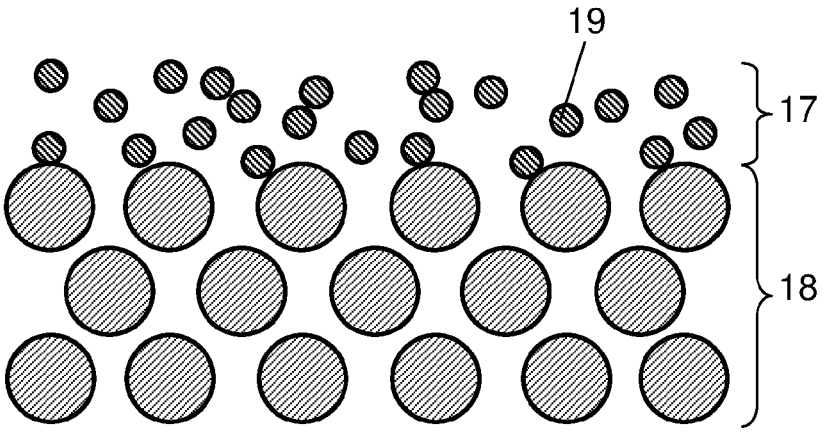
FIG. 5 is a cross-sectional view showing a base material of a partition member for total heat exchange element of the total heat exchange type ventilation device.
Figure 6:
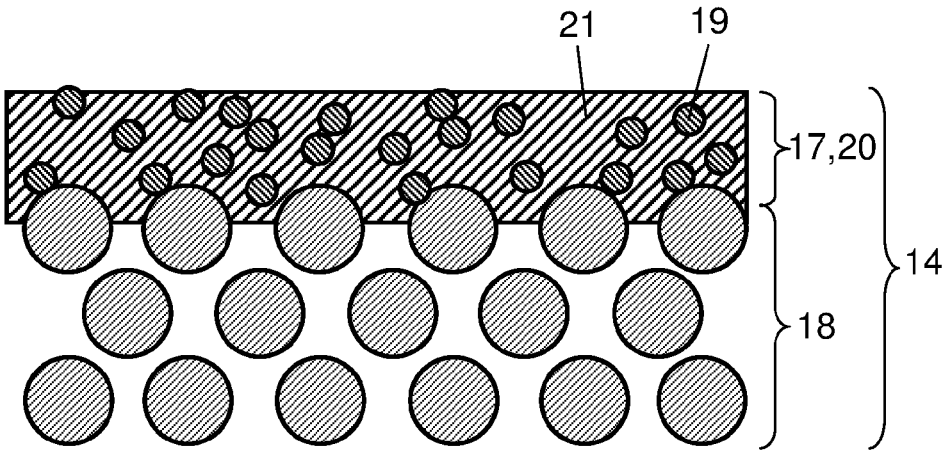
FIG. 6 is a cross-sectional view showing the partition member for total heat exchange element of the total heat exchange type ventilation device.

FIG. 5 is a cross-sectional view showing a base material of the partition member for total heat exchange element of the total heat exchange type ventilation device according to the exemplary embodiment of the present invention. FIG. 6 is a cross-sectional view of the partition member for total heat exchange element of the total heat exchange type ventilation device according to the exemplary embodiment of the present invention. The base material of partition member for total heat exchange element 14 shown in FIG. 6 includes, as shown in FIG. 5, porous sheet 18 and ultrafine fiber portion 17 as an ultrafine fiber layer stacked on porous sheet 18. Then, by ultrafine fiber portion 17 shown in FIG. 5 being impregnated with or coated with moisture permeable substance 21 shown in FIG. 6 and water-insolubilized, partition member for total heat exchange element 14 is formed.

As shown in FIG. 6, moisture permeable substance 21 is coated to fill the spaces among ultrafine fibers 19, and moisture permeable portion 20 is stacked on porous sheet 18, whereby partition member for total heat exchange element 14 is obtained. Since the fiber diameter of ultrafine fibers 19 structuring ultrafine fiber portion 17 is small, ultrafine fiber portion 17 becomes a thin layer in which the average pore diameter is small and voidage is high. Further, ultrafine fibers 19 can retain moisture permeable substance 21 by capillary force, and accordingly moisture permeable portion 20 can be formed to be thin. Still further, the proportion of moisture permeable substance 21 contained in moisture permeable portion 20 can be increased.

The sites that become the resistance to permeation of partition member for total heat exchange element 14 are moisture permeable portion 20 and porous sheet 18. Moisture passes through voids of porous sheet 18 and moisture permeable substance 21 of moisture permeable portion 20. By comparing the voids of porous sheet 18 and moisture permeable substance 21 against each other, the voids in which moisture can shift in the form of water vapor is less prone to become the resistance. Therefore, the resistance of moisture permeable portion 20 filled with moisture permeable substance 21 determines the permeability. Accordingly, when moisture permeable portion 20 is formed to be thin, the moisture permeation performance of partition member for total heat exchange element 14 improves. Further, the moisture permeability of ultrafine fibers 19 contained in moisture permeable portion 20 is lower than that of moisture permeable substance 21. Accordingly, the moisture permeation performance is improved also by an increase in the proportion of moisture permeable substance 21 contained in moisture permeable portion 20.

Further, it is also possible that porous sheet 18 having an average pore diameter of 15 μm or more and 100 μm or less and a thickness of 20 μm or more and 500 μm or less and ultrafine fiber portion 17 having an average pore diameter of 0.01 μm or more and 10 μm or less and a thickness of 0.5 μm or more and 20 μm or less are stacked.

Since porous sheet 18 is provided with pores whose average pore diameter is 15 μm or more, drainage of moisture permeable substance 21 is facilitated. Then, since moisture permeable portion 20 approximates the thickness of ultrafine fiber portion 17, the moisture permeation performance improves. However, when porous sheet 18 is provided with pores whose average pore diameter is greater than 100 μm, the porous sheet 18 may be incapable of holding moisture permeable portion 20 when moisture permeable portion 20 is thin. Further, when the thickness of porous sheet 18 is less than μm, the strength may be insufficient, and when the thickness exceeds 500 μm, the moisture permeation performance may reduce.

Ultrafine fibers 19 in the present invention refers to fibers whose fiber diameter is 0.1 μm or more and 3 μm or less. By ultrafine fibers 19 having this fiber diameter, porous sheet 18 can realize the average pore diameter and the thickness described above. Porous sheet 18 is not limited to nonwoven fabric or woven fabric. However, in the case where porous sheet 18 is nonwoven fabric or woven fabric, the fiber diameter thereof is greater than that of ultrafine fibers 19, and the fiber diameter of 3 μm to 50 μm is suitable. When the fiber diameter of porous sheet 18 is smaller than 3 μm, the strength of a filament is low, and hence the strength as a reinforce member is insufficient. Further, when the fiber diameter of porous sheet 18 is 50 μm or more, the thickness of porous sheet 18 becomes great and the moisture permeation performance reduces, and hence such a fiber diameter is not preferable.

When the average pore diameter of ultrafine fiber portion 17 is 10 μm or less, moisture permeable substance 21 entwines with ultrafine fiber portion 17, whereby moisture permeable substance 21 is suppressed from coming off. However, when the average pore diameter of ultrafine fiber portion 17 is less than 0.01 μm, the sites where moisture permeable substance 21 is linearly disposed in the thickness direction of moisture permeable portion 20 reduce. Accordingly, the shifting distance of moisture becomes long, whereby the moisture permeation performance may reduce. Further, when the thickness of ultrafine fiber portion 17 is less than 0.5 μm, pinholes tend to partially be produced, whereby the gas barrier property of partition member for total heat exchange element 14 may not be secured. Further, when the thickness of ultrafine fiber portion 17 exceeds 20 μm, moisture permeable portion 20 becomes extremely thick, whereby the moisture permeation performance may reduce.

Further, moisture permeable substance 21 may be turned into macromolecules by impregnation or coating of a low-molecular-weight hydrophilic organic compound, followed by polymerization and water-insolubilization.

By ultrafine fiber portion 17 being coated with a low-molecular-weight organic compound, the low-molecular-weight organic compound infiltrates through fine pores of ultrafine fiber portion 17. Thereafter, the low-molecular-weight organic compound is polymerized and moisture permeable substance 21 is water-insolubilized. Thus, moisture permeable portion 20 filled with moisture permeable substance 21 more densely is obtained. As a result, the moisture permeation resistance of moisture permeable portion 20 reduces, and the moisture permeation performance of partition member for total heat exchange element 14 improves.

Further, porous sheet 18 may contain a heat-fusing component. After porous sheet 18 and ultrafine fiber portion 17 are thermally bonded to each other, ultrafine fiber portion 17 may be impregnated with or coated with moisture permeable substance 21.

By porous sheet 18 and ultrafine fibers 19 being bonded to each other by the heat-fusing component of porous sheet 18 and without use of a moisture permeation inhibiting substance such as an adhesive agent, the moisture permeation performance of partition member for total heat exchange element 14 improves. Further, ultrafine fibers 19 are easily and evenly bonded to porous sheet 18. Accordingly, when ultrafine fibers 19 are impregnated with or coated with moisture permeable substance 21, ultrafine fibers 19 are suppressed from peeling off from porous sheet 18. As a result, loss of moisture permeable portion 20 can also be suppressed, and hence the gas barrier property of partition member for total heat exchange element 14 also improves.

Further, after ultrafine fiber portion 17 is impregnated with or coated with moisture permeable substance 21, porous sheet 18 and ultrafine fiber portion 17 may be thermally bonded to each other. This prevents infiltration of moisture permeable substance 21 into porous sheet 18. Accordingly, a reduction in voidage of porous sheet 18 is suppressed. As compared to the case where ultrafine fiber portion 17 is thermally bonded to porous sheet 18 and thereafter impregnated with or coated with moisture permeable substance 21, that is, the case where the thermal bonding is firstly performed, a reduction in the moisture permeation performance of porous sheet 18 is suppressed in the case where the thermal bonding is performed as the later process. Hence, a reduction in the moisture permeation performance of partition member for total heat exchange element 14 can be suppressed, and therefore it is suitable to perform thermal bonding as the later process.

Further, porous sheet 18 may contain a heat-fusing component, and porous sheet 18 and ultrafine fibers 19, and porous sheet 18 and moisture permeable substance 21 may be thermally bonded to each other.

By porous sheet 18 and ultrafine fibers 19, and porous sheet 18 and moisture permeable substance 21 being bonded to each other by the heat-fusing component of porous sheet 18 and without use of a moisture permeation inhibiting substance such as an adhesive agent, the moisture permeation performance of partition member for total heat exchange element 14 improves. Further, moisture permeable portion 20 is easily and evenly bonded to porous sheet 18. Accordingly, loss of moisture permeable portion 20 caused by moisture permeable portion 20 peeling off from porous sheet 18 can be suppressed. The gas barrier property of partition member for total heat exchange element 14 also improves.

Further, as moisture permeable substance 21, an agent including a quaternary ammonium group may be used. Since a quaternary ammonium group exhibits great charge disproportionation and does not form a hydrogen bond with a water molecule, it has high moisture absorption and desorption properties. Accordingly, the moisture permeation performance of partition member for total heat exchange element 14 improves.

Further, as the heat-fusing component of porous sheet 18, a polymer having a hydrophilic group may be used. This allows the surface of porous sheet 18 to easily absorb water vapor, whereby the concentration of water vapor in voids of porous sheet 18 tends to increase. As a result, water vapor shift from room air 15 or outdoor air 16 in FIG. 4 into voids of porous sheet 18 is facilitated. That is, water vapor shift from room air 15 or outdoor air 16 to moisture permeable portion 20 via voids of porous sheet 18 is facilitated, whereby the moisture permeation performance of partition member for total heat exchange element 14 increases.

Further, porous sheet 18 may be formed by sheath-core bicomponent fibers including a low-melting point component capable of thermally fusing in its outer layer and a high-melting point component in its the inner layer. Thus, even when the low-melting point component of the outer layer reaches a thermally fusible temperature, the high-melting point component of the inner layer does not melt. Accordingly, the thermal contraction of porous sheet 18 does not occur and porous sheet 18 maintains its shape constantly. Ultrafine fiber portion 17 or moisture permeable portion 20 does not easily deform and shrink by thermal contraction of porous sheet 18 in bonding. As a result, a reduction in the moisture permeation performance by an increase in the thickness of moisture permeable portion 20 is suppressed.

Further, the bonding point between porous sheet 18 and moisture permeable portion 20 is formed around the point where porous sheet 18 and moisture permeable portion 20 are in contact with each other. Accordingly, the surface area of moisture permeable portion 20 opposing to porous sheet 18 increases, whereby the moisture permeation performance of partition member for total heat exchange element 14 improves. Further, since porous sheet 18 does not easily deform when bonded, loss of moisture permeable portion 20 attributed to peeling off of moisture permeable portion 20 can be suppressed, and the gas barrier property of partition member for total heat exchange element 14 also improves.

Further, any of the above-described partition members for total heat exchange element 14 may be used for total heat exchange element 4. Use of partition member for total heat exchange element 14 having high moisture permeation performance for total heat exchange element 4 provides total heat exchange element 4 exhibiting high latent heat exchange efficiency.

Further, the above-described total heat exchange element 4 may be used for total heat exchange type ventilation device 2. Use of total heat exchange element 4 exhibiting high latent heat exchange efficiency for total heat exchange type ventilation device 2 provides total heat exchange type ventilation device 2 exhibiting high total heat exchange efficiency.

Porous sheet 18 may be, for example, nonwoven fabric, a plastic film, or woven fabric. The material of porous sheet 18 is preferably a water-resistant substance. For example, it may be polypropylene, polyethylene, polytetrafluoroethylene, polyester, polyamide, polyimide, polyethersulfone, polyacrylonitrile, polyvinylidene difluoride or the like.

Note that, the heat-fusing component of porous sheet 18 is preferably a substance having a hydrophilic functional group. For example, it may be polymer in which a hydrophilic group is introduced by graft polymerization into a low-melting point component such as polyethylene, polyester, polypropylene or the like.

Further, the material of ultrafine fibers 19 is also preferably a water-resistant substance, and may be made of a substance identical to porous sheet 18. Still further, though an exemplary scheme of manufacturing ultrafine fibers 19 is the melt-blown process, electrospinning or the like, without being limited thereto, other known scheme may be used.

Note that, moisture permeable substance 21 is preferably a macromolecule having a hydrophilic functional group, such as a hydroxyl group, a sulfone group, an ester bond, a urethane bond, a carboxyl group, a carbo group, a phosphate group, an amino group, a quaternary ammonium group or the like. In particular, as described above, a quaternary ammonium group has high moisture absorption and desorption properties and therefore is preferable.

Note that, the method for adding moisture permeable substance 21 to ultrafine fiber portion 17 may be impregnation or coating, and particularly coating with which a coating amount can be controlled is preferable. As the coating method, known scheme such as spraying, gravure coating, die coating, inkjet coating, comma coating or the like may be employed.

Note that, as the method for water-insolubilizing moisture permeable substance 21, other than the obtaining a macromolecule by polymerization described above, a method including coating and thereafter processing with a bridging material, a method including dissolving a water-insoluble macromolecule into an organic solvent, applying and drying the same, or a method including thermally fusing a water-insoluble macromolecule and cooling the same may be employed.

Note that, when polymerizing moisture permeable substance 21, in addition to a low-molecular-weight hydrophilic organic compound, an organic compound having a plurality of polymerizing sites may be added as a bridging material. By adding such a bridging material, an improvement in the water resistance property of the high-molecular-weight organic compound after polymerization, an increase in the strength of moisture permeable portion 20, and the effect of suppressing swelling due to water absorption can be achieved.

Note that, the method for polymerizing moisture permeable substance 21 may be radical polymerization, ionic polymerization, ring-opening polymerization or the like. In particular, radical polymerization which brings about a rapid increase in molecular weight is suitable. This is because the high-molecular-weight compound after polymerization easily stays at ultrafine fiber portion 17 because of the rapidly increased molecular weight, and hence uniform moisture permeable portion 20 can be easily formed. The radical polymerization method may be any known scheme, for example, polymerization using heat, ultraviolet rays, radiation rays or the like. In particular, when radiation rays are used in polymerization, water resistance property improves because bonding between moisture permeable substance 21 and ultrafine fibers 19 is enabled.

INDUSTRIAL APPLICABILITY

The partition member for total heat exchange element of the present invention is useful for a total heat exchange element, a total heat exchange type ventilation device, and the like.

REFERENCE MARKS IN THE DRAWINGS

1 house
2 total heat exchange type ventilation device
3 body case
4 total heat exchange element
5 fan
6 room air port
7 exhaust air port
8 fan
9 outdoor air port
10 supply air port
11 frame
12 room air duct rib
13 outdoor air duct rib
14 partition member for total heat exchange element
15 room air
16 outdoor air
17 ultrafine fiber portion
18 porous sheet
19 ultrafine fibers
20 moisture permeable portion
21 moisture permeable substance

The invention claimed is:

1. A partition member for total heat exchange element, the member comprising:

a porous sheet; and an ultrafine fiber portion provided on the porous sheet, the ultrafine fiber portion comprising ultrafine fibers having a fiber diameter of 0.1 μm or more and 3 μm or less, wherein the ultrafine fiber portion is impregnated with or coated with a water insoluble moisture permeable substance, and wherein the ultrafine fiber portion includes ultrafine fibers which retain a moisture permeable substance by capillary force.

2. The partition member for total heat exchange element according to claim 1, wherein the porous sheet has an average pore diameter of 15 μm or more and 100 μm or less and a thickness of 20 μm or more and 500 μm or less, and the ultrafine fiber portion has an average pore diameter of 0.01 μm or more and 10 μm or less and a thickness of 0.5 μm or more and 20 μm or less.

3. The partition member for total heat exchange element according to claim 1, wherein the water insoluble moisture permeable substance comprises a macromolecule of a low-molecular-weight hydrophilic organic compound, the macromolecule being impregnated or coated on the ultrafine fibers, and the macromolecule being produced by polymerization of the low-molecular-weight hydrophilic organic compound.

4. The partition member for total heat exchange element according to claim 1, wherein the porous sheet contains a heat-fusing component, and the porous sheet and the ultrafine fiber portion are thermally bonded to each other by the heat-fusing component.

5. The partition member for total heat exchange element according to claim 1, wherein the water insoluble moisture permeable substance includes a quaternary ammonium group.

6. The partition member for total heat exchange element according to claim 4, wherein the heat-fusing component is a polymer having a hydrophilic group.

7. The partition member for total heat exchange element according to claim 1, wherein the porous sheet is structured of a sheath-core composite including a low-melting point component capable of thermally fusing in its outer layer and a high-melting point component in its inner layer.

8. A total heat exchange element using the partition member for total heat exchange element according to claim 1.

9. A total heat exchange type ventilation device using the total heat exchange element according to claim 8.

* * * * *